US011603254B1

(12) United States Patent
Forouzandeh et al.

(10) Patent No.: US 11,603,254 B1
(45) Date of Patent: Mar. 14, 2023

(54) MINIATURE PRESSURE-DRIVEN PUMPS

(71) Applicant: UNIVERSITY OF SOUTH FLORIDA, Tampa, FL (US)

(72) Inventors: Farzad Forouzandeh, Rochester, NY (US); David Borkholder, Canandaigua, NY (US); Robert Frisina, Tampa, FL (US); Joseph Walton, Tampa, FL (US); Xiaoxia Zhu, Tampa, FL (US)

(73) Assignee: UNIVERSITY OF SOUTH FLORIDA, Tampa, FL (US)

( * ) Notice: Subject to any disclaimer, the term of this patent is extended or adjusted under 35 U.S.C. 154(b) by 212 days.

(21) Appl. No.: 17/074,258

(22) Filed: Oct. 19, 2020

Related U.S. Application Data

(60) Provisional application No. 62/923,417, filed on Oct. 18, 2019.

(51) Int. Cl.
*B65D 83/14* (2006.01)
*F04B 43/00* (2006.01)
*F04B 43/06* (2006.01)

(52) U.S. Cl.
CPC ..... *B65D 83/14* (2013.01); *F04B 43/0054* (2013.01); *F04B 43/06* (2013.01)

(58) Field of Classification Search
CPC ..... B65D 83/14; F04B 43/0054; F04B 43/06
USPC ..... 222/401
See application file for complete search history.

(56) References Cited

U.S. PATENT DOCUMENTS 4,158,530 A * 6/1979 Bernstein ..... F04B 43/1133 417/389
4,936,758 A * 6/1990 Coble ..... F04B 43/04 92/103 SD
5,088,515 A * 2/1992 Kamen ..... G05D 16/0636 137/315.04
5,593,290 A * 1/1997 Greisch ..... F04B 43/021 417/478
6,280,148 B1 * 8/2001 Zengerle ..... F04B 19/006 417/44.1

(Continued)

FOREIGN PATENT DOCUMENTS

WO WO-2015073881 A2 * 5/2015 ..... B01L 3/502738

OTHER PUBLICATIONS

Prometra Pump, Flowonix, Aug. 20, 2020, 2 pages.
Rauck et al., Accuracy and efficacy of intrathecal administration of morphine sulfate for treatment of intractable pain using the Prometra® Programmable Pump, 2010, pp. 102-108 ( 7 pages), vol. 13, Neuromodulation: Technology at the Neural Interface, International Neuromodulation Society.

(Continued)

*Primary Examiner* — Paul R Durand
*Assistant Examiner* — Michael J. Melaragno

(57) ABSTRACT

A miniature pump including a first chamber, a second chamber, a deformable membrane provided within the second chamber that divides the second chamber into first and second sub-chambers, the second sub-chamber defining a reservoir configured to contain liquid to be dispensed, a passage that connects the first chamber to the first sub-chamber, and an outlet in fluid communication with the reservoir, wherein pressurized fluid within the first internal chamber flows through the passage and into the first sub-chamber to compress the deformable membrane and cause liquid contained within the reservoir to flow out from the reservoir through the outlet and wherein the deformable membrane does not generate significant restoring forces when it is deformed and, therefore, will not return to its initial undeformed shape unless the reservoir is refilled.

16 Claims, 5 Drawing Sheets

(56) References Cited

U.S. PATENT DOCUMENTS

| | | | | |
|---|---|---|---|---|
| 6,435,844 | B1 * | 8/2002 | Fukami | F04B 43/0054 417/395 |
| 8,038,640 | B2 * | 10/2011 | Orr | A61M 60/851 417/477.2 |
| 11,287,358 | B1 * | 3/2022 | Nath | G01F 1/34 |
| 11,306,709 | B2 * | 4/2022 | Anderle | A61M 1/14 |
| 2001/0018909 | A1 * | 9/2001 | Ishikawa | F04B 43/06 417/246 |
| 2004/0115068 | A1 * | 6/2004 | Hansen | F04B 19/24 417/379 |
| 2005/0159700 | A1 | 7/2005 | Keusch et al. | |
| 2009/0137940 | A1 * | 5/2009 | Orr | A61M 60/43 604/82 |
| 2012/0288889 | A1 * | 11/2012 | Miyamura | G01N 15/12 206/524.1 |
| 2013/0058805 | A1 * | 3/2013 | Chien | F04B 43/1133 417/395 |
| 2014/0094736 | A1 * | 4/2014 | Dos Santos | A61F 9/00781 604/9 |
| 2015/0351648 | A1 * | 12/2015 | Harvey | A61B 5/076 600/561 |
| 2016/0100604 | A1 * | 4/2016 | Rubin | A23G 1/005 426/520 |
| 2019/0144913 | A1 * | 5/2019 | Pulitzer | B01L 3/50273 435/32 |
| 2021/0252510 | A1 * | 8/2021 | Schaffer | F16K 99/0028 |
| 2021/0268748 | A1 * | 9/2021 | Frische | F04B 43/043 |
| 2021/0322681 | A1 * | 10/2021 | Bolognia | A61M 5/31586 |

OTHER PUBLICATIONS

Reynaerts et al., A SMA-actuated implantable system for delivery of liquid drugs, Jun. 26-28, 1996, pp. 379-382 (4 pages). In Proceedings of the Fifth International Conference on New Actuators, Actuator 96, Bremen, Germany.

Rogers et al., 3D printed microfluidic devices with integrated valves, 2015, 10 pages, vol. 9, Document No. 016501, Biomicrofluidics, AIP publishing LLC.

Roxhed et al., Painless drug delivery through microneedle-based transdermal patches featuring active infusion, 2008, pp. 1063-1071 (9 pages), vol. 55, Issue No. 3, IEEE Transactions on Biomedical Engineering.

Salt et al., Perilymph pharmacokinetics of marker applied through a cochlear implant in guinea pigs, Aug. 17, 2017, 20 pages, vol. 12, Issue No. 8, Document No. e0183374, PLoS One.

Sanjay et al., Controlled drug delivery using microdevices, 2016, 29 pages (pp. 772-787), vol. 17, Issue No. 9, Current pharmaceutical biotechnology.

Sanjay et al., Recent advances of controlled drug delivery using microfluidic platforms, 2018, pp. 3-28 (26 pages), vol. 128, Advanced drug delivery reviews.

Shepherd et al., Soft machines that are resistant to puncture and that self seal, 2013, pp. 6709-6713 (27 pages), vol. 25, Issue 46, Advanced Materials.

Sheybani et al., Wireless programmable electrochemical drug delivery micropump with fully integrated electrochemical dosing sensors, 2015, pp. 1-13 (13 pages), vol. 17, Article No. 74, Biomedical microdevices.

Specialty Coating Systems, Parylene for Medical Devices: Using Parylene to Protect Medical Devices, published Jun. 7, 2012.

Specialty Coating Systems, SCS Parylene Properties, Aug. 12, 2021.

Stevenson et al., Reservoir-based drug delivery systems utilizing microtechnology, Nov. 2012, pp. 1590-1602 (13 pages), vol. 64, Advanced drug delivery reviews.

Stoeber et al., Design, fabrication and testing of a MEMS syringe, 2002,4 pages, In Proceedings of Solid-State Sensor and Actuator Workshop.

Strum et al., Improved methods for venous access: the Port-A-Cath, a totally implanted catheter system, 1986, pp. 596-603 (8 pages), vol. 4, Issue No. 4, Journal of Clinical Oncology, American Society of Clinical Oncology.

Sutradhar et al., Implantable microchip: the futuristic controlled drug delivery system, Apr. 24, 2014, 33 pages, vol. 23, 2016, Issue 1, Drug Delivery.

Tan et al., Drug delivery: Enabling technology for drug discovery and development. iPRECIO® Micro Infusion Pump: programmable, refillable, and implantable, Jul. 2011, 13 pages, vol. 4, Article No. 44, Frontiers in Pharmacology.

Tandon et al., Microfabricated reciprocating micropump for intracochlear drug delivery with integrated drug/fluid storage and electronically controlled dosing, Mar. 7, 2016, pp. 829-846 (19 pages), vol. 16, Issue No. 5, Lab on a Chip.

Tng et al., Approaches and challenges of engineering implantable microelectromechanical systems (MEMS) drug delivery systems for in vitro and in vivo applications, 2012, pp. 615-631 vol. 3, Issue No. 4., Micromachines.

U.S. Department of Health and Human Services Food and Drug Administration Center for Drug Evaluation and Research (CDER), Guidance for Industry: Estimating the Maximum Safe Starting Dose in Initial Clinical Trials for Therapeutics in Adult Healthy Volunteers; Jul. 2005, 30 pages, CDER, Pharmacology and Toxicology, Rockville, MD, USA.

Urquhart et al., Rate-controlled delivery systems in drug and hormone research, 1984, pp. 199-236 (36 pages), vol. 24, Annual review of pharmacology and toxicology.

Van Der Maaden et al., Microneedle technologies for (trans) dermal drug and vaccine delivery, 2012, pp. 645-655 (11 pages, vol. 161, Journal of controlled release.

Zini et al., Use of an implantable pump for controlled subcutaneous insulin delivery in healthy cats, 2017, pp. 60-64 (5 pages), vol. 219, The Veterinary Journal.

Ali et al., "Design, Development, and Optimization of Dexibuprofen Microemulsion Based Transdermal Reservoir Patches for Controlled Drug Delivery," Sep. 27, 2017, 12 pages, vol. 2017, Article ID 4654958, Hindawi, BioMed Research International.

Andrews et al., Long-term central venous access with a peripherally placed subcutaneous infusion port: initial results, 1990, pp. 45-47 (3 pages), vol. 176, Issue No. 1, Radiology.

Armani et al., Re-configurable fluid circuits by PDMS elastomer micromachining, 1999, pp. 222-227 (6 pages), Technical Digest, IEEE International MEMS 99 Conference, Twelfth IEEE International Conference on Micro Electro Mechanical Systems (Cat. No. 99CH36291).

Avantor, NuSil MED-6215 Optically Clear Low Consistency Silicone Elastomer, Nov. 30, 2018, 3 pages.

Benedikz et al., The rat as an animal model of Alzheimer's disease, 2009, pp. 1034-1042 (9 pages), vol. 13, Issue No. 6, Journal of cellular and molecular medicine.

Berteau et al., Evaluation of the impact of viscosity, injection volume and injection flow rate on subcutaneous injection tolerance, Nov. 11, 2015, pp. 473-484 (12 pages), vol. 8, Medical Devices, Auckland, NZ.

Borkholder et al., Round window membrane intracochleardrug delivery enhanced by induced advection, 2014, pp. 171-176 (6 pages), vol. 174, Journal of controlled release.

Cantwell et al., Modular reservoir concept for MEMS-based transdermal drug delivery systems, 2014, 7 pages, vol. 24, Issue No. 11, Document No. 117001, Journal of Micromechanics and Microengineering.

Chung et al., A robust, electrochemically driven microwell drug delivery system for controlled vasopressin release, Apr. 8, 2009, pp. 861-867 (7 pages), vol. 11, Biomedical microdevices.

Cobo et al., A wireless implantable micropump for chronic drug infusion against cancer, 2016, pp. 18-25 (8 pages), vol. 239, Sensors and Actuators A: Physical.

Durect, DUR-928, Jul. 24, 2018, 1 page.

Elman et al., An implantable MEMS drug delivery device for rapid delivery in ambulatory emergency care, Jan. 24, 2009, pp. 625-631, vol. 11, Biomedical microdevices.

Evans et al., A multidrug delivery system using a piezoelectrically actuated silicon valve manifold with embedded sensors, Feb. 2011, pp. 231-238 (8 pages), vol. 20, Issue No. 1, Journal of microelectromechanical systems.

(56) References Cited

OTHER PUBLICATIONS

Formlabs, Class IIa Long-Term Biocompatible Resin for Form, Oct. 4, 2017, 2 pages.
Forouzandeh et al., A 3D-printed modular microreservoir for drug delivery, 2020, 17 pages, vol. 11, Issue No. 7, Article No. 648, Micromachines.
Forouzandeh et al., A nanoliter resolution implantable micropump for murine inner ear drug delivery, 2019, pp. 27-37 (11 pages), vol. 298, Journal of controlled release.
Forouzandeh et al., A review of peristaltic micropumps, 2021, pp. 1-16 (16 pages), vol. 326, Document No. 112602, Sensors and Actuators A: Physical.
Forouzandeh et al., A wirelessly controlled fully implantable microsystem for nano-liter resolution inner ear drug delivery, Jun. 3-7, 2018, pp. 38-41 (4 pages), Solid-State Sensors, Actuators, and Microsystems Workshop, Hilton Head Island, South Carolina, USA.
Forouzandeh et al., Microtechnologies for inner ear drug delivery, 2020, pp. 323-328, vol. 28, Issue No. 5, Current opinion in otolaryngology & head and neck surgery.
Forouzandeh, Farzad, Implantable Microsystem Technologies for Nanoliter-Resolution Inner Ear Drug Delivery, Aug. 28, 2018, 111 pages, Rochester Institute of Technology.
Frisina et al., Age-related hearing loss: prevention of threshold declines, cell loss and apoptosis in spiral ganglion neurons, 2016, pp. 2081-2099 (19 pages), vol. 8, Issue No. 9. Aging, Albany NY.
Gensler et al., An implantable MEMS micropump system for drug delivery in small animals, 2012, pp. 483-496 (14 pages). vol. 14, Biomedical microdevices.
Gensler, Heidi Marie, A Wireless Implantable MEMS Micropump System for Site-specific Anti-cancer Drug Delivery, 2013, 24 pages. University of Southern California.
Hafeli et al., In vivo evaluation of a microneedle-based miniature syringe for intradermal drug delivery, Apr. 4, 2009, pp. 943-950 (8 pages), vol. 11, Biomedical microdevices.
Hamilton Company, GC Septa, Jun. 6, 2021, 3 pages.
HamiltonCompany, Hamilton Reference Guide: Syringes and Needles, copyright 2018, 128 pages.
Henkel Adhesives, Medical: Unique adhesive solutions for unique medical product challenges, May 28, 2020, 5 pages.
Hsu et al., Biocompatible magnetic nanocomposite microcapsules as microfluidic one-way diffusion blocking valves with ultra-low opening pressure, 2018, pp. 86-93 (8 pages), vol. 150, Materials & design.
Humayun et al., Implantable micropump for drug delivery in patients with diabetic macular edema, 2014, 8 pages, vol. 3, Issue No. 6, Article No. 5, Translational vision science & technology.
IPRECIO, 2020, 2 pages.
IPRECIO, SMP-310R, Copyright 2020, 2 pages.
John Hopkins University, The Mouse, Apr. 11, 2020, 9 pages.
Johnson et al., In-plane biocompatible microfluidic interconnects for implantable microsystems, Apr. 2011, pp. 943-948 (6 pages), vol. 58, Issue No. 4, IEEE Transactions on Biomedical Engineering.
Johnson et al., Towards an implantable, low flow micropump that uses No. power in the blocked-flow state, 2016,16 pages. vol. 7, Issue No. 6, Article No. 99, Micromachines.
Kochhar et al., Microneedle integrated transdermal patch for fast onset and sustained delivery of lidocaine, 2013, pp. 1272-4280 (9 pages), vol. 10, Molecular pharmaceutics.
Kort et al., A microchip implant system as a method to determine body temperature of terminally ill rats and mice, 1998, pp. 260-269 (10 pages), vol. 32, Laboratory animals, Laboratory Animals Ltd.
Laser et al., A review of micropumps, 2004, pp. R35-64 (31 pages), vol. 14, Issue No. 6, Journal of micromechanics and microengineering.
Lee et al., Advances in self-healing materials based on vascular networks with mechanical self-repair characteristics, 2017, 50 pages, Advances in Colloid and Interface Science.
Li et al., An electrochemical intraocular drug delivery device, 2008, pp. 41-48 (8 pages), vol. 143, Sensors and Actuators A: Physical.
Li et al., Compact, power-efficient architectures using microvalves and microsensors, for intrathecal, insulin, and other drug delivery systems, 2012, pp. 1639-1649 (11 pages), vol. 64, Advanced drug delivery reviews.
Liu et al., Biocompatibility investigation of polyethylene glycol and alginate-poly-L-lysine for islet encapsulation, 2010, pp. 241-245 (5 pages), ASAIO journal.
Lo et al., A passive MEMS drug delivery pump for treatment of ocular diseases, Apr. 25, 2009, pp. 959-970 (12 pages), vol. 11, Biomedical microdevices.
Lo et al., A passive refillable intraocular MEMS drug delivery device, May 9-12, 2006, pp. 74-77 (44 pages), International Conference on Microtechnologies in Medicine and Biology, IEEE, Okinawa, Japan.
Lo et al., A refillable microfabricated drug delivery device for treatment of ocular diseases, 2008, pp. 1027-1030 (4 pages), vol. 8, Lab on a Chip, The Royal Society of Chemistry.
Lo et al., Integrated and reusable in-plane microfluidic interconnects, 2008, pp. 531-539 (9 pages), vol. 132, Sensors and Actuators B: Chemical.
Mousoulis et al., A skin-contact-actuated micropump for transdermal drug delivery, 2011, pp. 1492-1498 ( 7 pages), vol. 58, Issue No. 5, IEEE transactions on biomedical engineering.
Nagai et al., A platform for controlled dual-drug delivery to the retina: protective effects against light-induced retinal damage in rats, 2014, pp. 1555-1560 (6 pages), vol. 3, Advanced healthcare materials.
Nordquist et al., Novel microneedle patches for active insulin delivery are efficient in maintaining glycaemic control: an initial comparison with subcutaneous administration, 2007, pp. 1381-1388 (8 pages), vol. 24, Issue No. 7, Pharmaceutical research.
Oka et al., Fabrication of a micro needle for a trace blood test, 2002, pp. 478-485, vols. 97-98, Sensors and Actuators A: Physical.
Oliver et al., Intracellular anions as the voltage sensor of prestin, the outer hair cell motor protein, Jun. 22, 2001, pp. 2340-2343 (5 pages), vol. 292, Science.

* cited by examiner

MINIATURE PRESSURE-DRIVEN PUMPS

CROSS-REFERENCE TO RELATED APPLICATION

This application is a continuation of U.S. Provisional Patent Application No. 62/923,417, entitled "Miniature Pumps" and filed on Oct. 18, 2019, which is incorporated by reference as if set forth herein in its entirety.

NOTICE OF GOVERNMENT-SPONSORED RESEARCH

This invention was made with Government support under grant contract number R01 DC014568 awarded by the National Institutes of Health (NIH). The Government has certain rights in the invention.

BRIEF DESCRIPTION OF THE DRAWINGS

The present disclosure may be better understood with reference to the following figures. Matching reference numerals designate corresponding parts throughout the figures, which are not necessarily drawn to scale.

BACKGROUND

Figure 1:
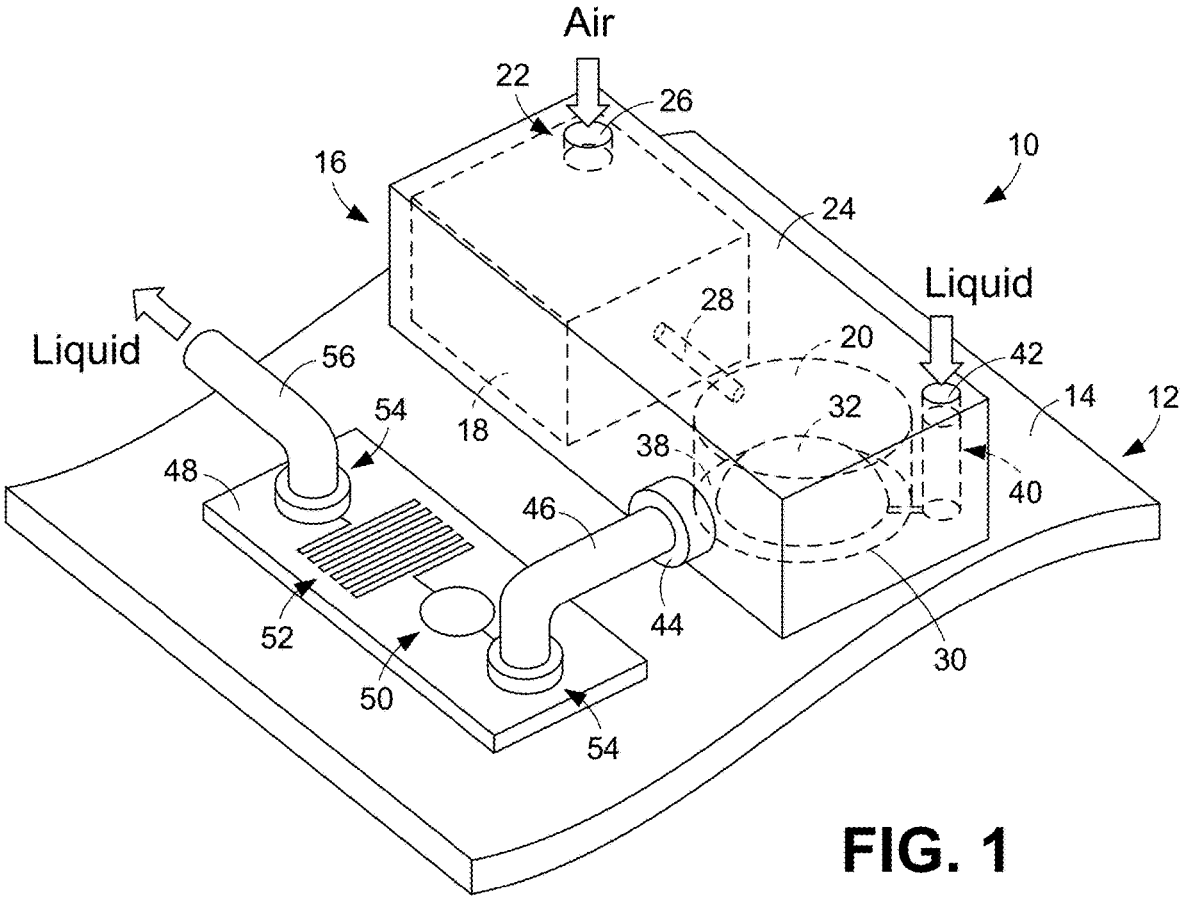
FIG. 1 is a perspective view of an embodiment of a miniature pressure-driven pump.

Fluid perfusion is required for various lab-on-chip (LOC) applications, such as maintaining viable cell cultures in microfluidic channels. Unfortunately, traditional pumping apparatus, such as characterization syringe pumps and constant pressure sources, are bulky and can be difficult to integrate with cell-based microfluidic systems that require incubation. It would be desirable to have pumps suitable for LOC applications that are less bulky and more easily integrated into microfluidic systems.

DETAILED DESCRIPTION

As expressed above, it would be desirable to have pumps suitable for lab-on-chip (LOC) applications that are less bulky and more easily integrated into microfluidic systems than conventional pumps. Disclosed herein are examples of such pumps. In some embodiments, a miniature pump is configured as a zero-power, plug-and-play pump that comprises a refillable liquid reservoir defined at least in part by a deformable membrane. When external pressure is applied to the membrane, for pneumatic pressure, the membrane is compressed and liquid is discharged from the reservoir.

In the following disclosure, various specific embodiments are described. It is to be understood that those embodiments are example implementations of the disclosed inventions and that alternative embodiments are possible. Such alternative embodiments include hybrid embodiments that include features from different disclosed embodiments. All such embodiments are intended to fall within the scope of this disclosure.

Disclosed herein is a zero-power, plug-and-play pump that comprises a refillable liquid reservoir defined at least in part by a deformable membrane. When liquid is to be pumped by the pump, the membrane is compressed by regulated pneumatic pressure and at least some of the liquid is discharged from the reservoir. In some embodiments, the membrane generates little or no restoring forces such that little or no backflow occurs when the pump is off. In some embodiments, the pump can be directly connected to a modular microfluidic device to provide fluid pumping without the need for electrical power.

Test results described below reveal that the flow rate of the pump can be controlled by adjusting the pneumatic pressure and/or the size of a flow constrictor, such that, in some cases, flow rates ranging from 35 nL/mm to 100 μL/mm can be achieved. For LOC applications, this range may be approximately 35 to 2,400 nL/mm. In some embodiments, a septum can be used to refill the reservoir. Testing of an experimental pump comprising such a septum showed no septum leakage after thousands of injections under up to approximately 15 psi of backpressure. Scalability of the reservoir was explored by fabricating multiple reservoirs of different capacities. The characterization of backflow in different capacities revealed less than 2% of the overall volume backflow and up to 95% fluid ejection. COMSOL Multiphysics® Modeling Software simulations were also performed and the results demonstrated minimal dependency on the flow rate to downstream height. Through the testing, it was concluded that the miniature pump provides robust long-term flows across a broad range of volumes from tens to thousands of nL/min. Due to the low-cost, biocompatible, and scalable fabrication methodology, as well as the plug-and-play usability of the pump, the device can be used in broad range of miniaturized (e.g., microfluidic) applications and, therefore, has the potential to replace traditional pumps for simple perfusion applications.

FIG. 1 illustrates an example configuration for a miniature pump 10 of the type discussed above. As shown in this figure, the pump 10 (or "pumping device") comprises a substrate 12 (shown in partial view) upon which the remainder of the pump's components are supported. The substrate 12 can be made of any suitably supportive material. In some embodiments, the substrate 12 is made of a polymer material, such as polymethyl methacrylate (PMMA), and can be formed using a deposition fabrication technique, such as three-dimensional (3D) printing.

Provided on a surface 14 of the substrate 12 is a pump body 16 that can also be made of a polymer material, such as a biocompatible resin. In some embodiments, the body 16 is coated with one or more layers of a durable biocompatible material, such as parylene C, using a suitable deposition process. In such cases, all surfaces of the body 16, including those of internal features of the body, are covered in that material. In the illustrated example, the body 16 is shaped as a rectangular cuboid, although other shapes are possible.

Formed within the pump body 16 are an internal air chamber 18 and an internal pump chamber 20. The air chamber 18 is in fluid communication with an air inlet port 22 that extends from the chamber to a top surface 24 of the body 16. As described below, air (or another fluid) can be delivered to the chamber 18 via the port 22. In some embodiments, the port 22 can include a valve 26 that enables air to be injected into (or withdrawn from) the chamber 18. In other embodiments, the port 22 could comprise a septum, similar to the septum described below, instead of a valve. Also in fluid communication with the air chamber 18 is an internal lateral passage that connects the air chamber 18 to the pump chamber 20. In some embodiments, this passage 28 comprises a bore that is formed through the pump body 16. In some embodiments, a valve (not shown) can also be provided within the bore. In such cases, that valve could be used as a shut off valve that can be actuated to shut the pump 10 off.

Figure 2:
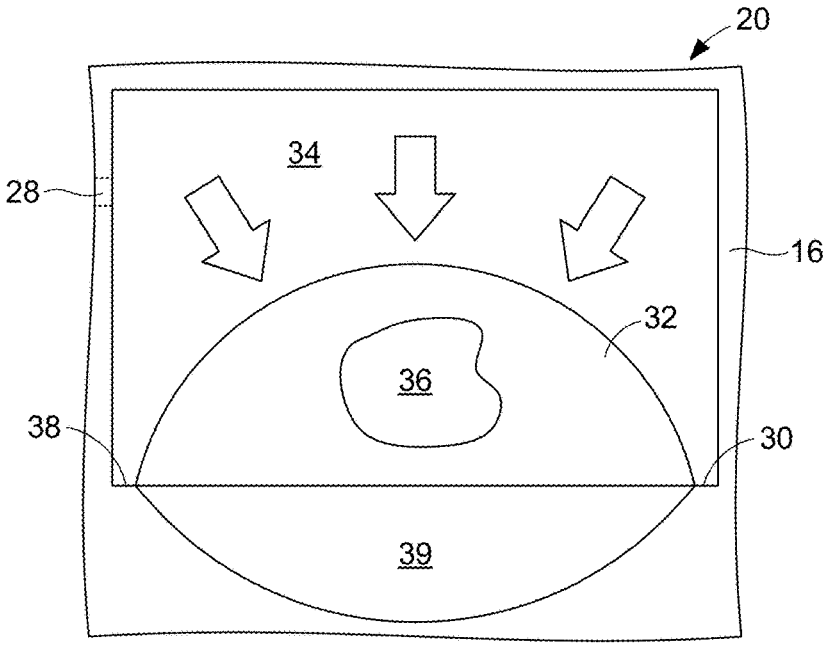
FIG. 2 is a schematic view of a pump chamber of the pump of FIG. 1.

In the illustrated embodiment, the pump chamber 20 is configured as a cylindrical chamber having a vertical central axis and an internal base 30. Provided within the chamber 20 is a deformable pump membrane 32 that helps define the liquid reservoir. As is most clearly illustrated in the schematic representation of the chamber 20 of FIG. 2, the membrane 32 separates the chamber into an upper air sub-chamber 34 and a lower liquid sub-chamber 36, the latter of which being used as (and being referable to as) a liquid reservoir of the pump 10. The membrane 32 is made of a material and has a thickness that enable the membrane to easily deform when pressure is applied to it by the air sub-chamber. In the embodiment illustrated in FIGS. 1 and 2, the pump membrane 32 comprises a thin dome-shaped element that has a base or bottom rim 38 that is securely attached to the base 30 of the pump chamber 20 and that extends upward within the chamber. In some embodiments, the portion 39 of the substrate covered by the membrane 32 (the membrane and that portion together defining the volume of the liquid reservoir) is convex, as shown in FIG. 2. In further embodiments, the substrate portion 39 has the inverse shape of the membrane 32, i.e., the magnitude of its concavity is equal to the magnitude of the membrane's convexity. In such cases, the substrate portion 39 and the membrane 32 have the same surface area and the membrane can lie flat on the substrate portion when all fluid has been discharged from the reservoir.

The membrane 32 can be made of one or more layers of a durable and flexible biocompatible polymer material. In some embodiments, the membrane 32 is made of a single layer of material that is no greater than 100 μm thick. By way of example, the layer can be approximately 2 to 20 μm thick. In some embodiments, the membrane is made of a silicone material having a Young's modulus of approximately 1 MPa. In other embodiments, the membrane 32 can be made of a parylene material, such as parylene C, which has a Young's modulus of approximately 2 to 3 GPa. As will be appreciated by persons having skill in the art, both of these parameters (i.e., Young's modulus and thickness) impact the membrane's ability to create restoring forces. Accordingly, those parameters can be adjusted in order to minimize the generation of restoring forces. For example, if the Young's modulus of the material is relatively high, the membrane can be thinner to achieve that result. If, on the other hand, the Young's modulus is relatively low, the membrane may can be thicker to achieve the result.

The material properties and thinness of the pump membrane 32 together ensure that, when the pump membrane 32 deforms (i.e., collapses) as fluid is discharged from the liquid reservoir defined in part by the membrane, little or no restoring forces are generated by the membrane and, therefore, little or no undesirable backflow of fluid away from the downstream destination for the fluid occurs. As such, once liquid is discharged from the liquid reservoir, the membrane 32 will not draw significant amounts of discharged fluid back into the reservoir. In some embodiments, less than 2% of the volume of discharged liquid undergoes backflow and is drawn back into the reservoir. In other embodiments, less than 0.5% of the volume of discharged liquid undergoes backflow and is drawn back into the reservoir. Accordingly, backflow can be limited to less than 0.5% of discharged liquid.

With further reference to FIG. 1, a fluid inlet port 40 is also formed in the pump body 16. This port 40 extends from the top surface 24 of the body 16 to the liquid reservoir 36 of the pump chamber 20 and, therefore, can be used to deliver fluid to (or remove fluid from) the reservoir. Provided within the port 40 is a resealable septum 42 that can be pierced by a filling element configured to deliver liquid to the reservoir 36, such as a needle, and that immediately reseals itself after the filling element has been withdrawn. In some embodiments, the septum 42 is made of a biocompatible material, such as a silicone material, and is firmly held in place by a compression ring (not visible) that induces lateral stress within the septum to enable the septum to be punctured thousands of times without leakage. Significantly, the port 40 and septum 42 are separate and independent of the pump membrane 32, which enables the membrane to be extremely thin and, therefore, minimize the generation of restoring forces.

Formed on the exterior of the pump body 16 is an fluid outlet 44 that is in fluid communication with the liquid reservoir 36. Accordingly, fluid can exit the reservoir 36 via the outlet 44. Connected to the outlet 44 is an outlet tube 46 that is configured to deliver the fluid to one or more downstream devices. As shown in FIG. 1, these downstream devices can be integrated with the remainder of the pump components and likewise be provided on or formed within the substrate 12. In the illustrated embodiment, the downstream devices include a platform 48 in which a debubbler 50 (configured to remove bubbles from the liquid) and a fluidic resistor 52 (configured to increase resistance of the output fluid flow to provide greater control over the flow rate) are provided. As shown in FIG. 1, connection between the outlet tube 46 and the platform 48 is facilitated with a connector mechanism 54 comprising a resilient O-ring that facilitates simple and fast connection of tubes to the platform. Fluid that flows through the outlet tube 46 passes through the connector mechanism 54 and to the debubbler 50, which is immediately upstream of the fluidic resistor 52. After passing through the debubbler 50 and the fluidic resistor 52, the liquid can exit the platform 48 and enter a further outlet tube 56 that is also connected to the platform with a connector mechanism 54. The tube 56 can then deliver the fluid to one or more further downstream devices that are either integrated with the above-described components or independent of them.

It is noted that fluidic resistance can, alternatively, be achieved by providing a small diameter passage through which discharged liquid must pass. For instance, a small diameter tube can be connected to the outlet 44 of the pipe to provide resistance similar to that provided by the fluidic resistor 52.

When the pump 10 is operated to deliver fluids, the pump membrane 32 is compressed so as to squeeze liquid out from the fluid reservoir 36. This compression can be achieved using regulated pneumatic pressure. Specifically, the air chamber 18 can be supplied with compressed air (or another gas), which then travels through the passage 28 and into the upper air sub-chamber 34 of the pump chamber 20. That air/gas pressurizes the air sub-chamber 34 and compresses the membrane 32 (downward in the embodiment of FIGS. 1 and 2). Once equilibrium is achieved between the air and liquid sub-chambers 34, 36, no further liquid is dispensed. Moreover, backward flow of liquid toward and into the fluid reservoir 36 is minimized or even avoided because of the above-described parameters of the membrane 32. Accordingly, the membrane 32 enables precision control for pumping and prevents backflow when the pump 10 is off. Because the pump is driven by pneumatic pressure, it can deliver fluid without any power being required.

Experimental pumps were fabricated and tests were performed on them to evaluate their operation. The body of the pump was 3D printed using a Formlab® Form 2™ stereolithography device with a biocompatible resin (Dental SG™), followed by 1-μm parylene deposition. 1000 μL of molten poly(ethylene glycol) (PEG) at 60° C. was deposited within the pump chamber to solidify and define the reservoir shape and volume. This was followed by another parylene deposition to create the pump membrane. A gasket was fabricated using a long-term biocompatible silicone material (Nusil®, MED6215) that was micro-molded and placed within the pump chamber surrounding the PEG dome. A 3D-printed compression ring was then placed on the gasket and affixed using cyanoacrylate to reinforce the seal between the two parylene C layers. The device was placed on a hotplate at 60° C. to melt the PEG, which was then washed away using by gentle injection of 10 mL of deionized (DI) water at 60° C.

A 2.5-mm diameter, 1-mm-thick septum made of long-term implantable silicone rubber was micro-molded and coated with 1 μm of parylene C. The septum was then placed in the liquid inlet port, which was 2.5 mm in diameter. A 3D-printed cap with an extruded compression ring on the septum area (2.5 mm OD, 1.8 mm ID) and a pneumatic port was affixed on top of the pump with cyanoacrylate to: (a) compress the septum providing a sealing force on the bottom and sides while enhancing the self-healing properties when punctured with refilling needles, (b) provide a pneumatic connection to the air chamber to apply pneumatic pressure on the pump membrane for pumping, and (c) protect the membrane from mechanical stress.

An air chamber was 3D printed with an inlet port for providing compressed air and a pneumatic passage leading to the liquid reservoir formed by the pump membrane. An air-tight septum was placed on the inlet port and the sealing and self-healing properties of the septum were achieved using a cap with a compression ring to induce lateral stress in the septum. The air chamber and pump chamber were connected through the pneumatic passage and sealed using cyanoacrylate. The air chamber was provided with openings for magnets. Four magnets (1 mm thickness, ⅛" diameter) were then placed in the designated openings.

A 0.5-mm polymethyl methacrylate (PMMA) sheet was next cut to form a substrate supporting the air and liquid chambers, a debubbler, a fluidic resistor, and a microfluidic chip. A second layer of PMMA was created to provide fluidic channels/passages for fluid flow between those components. A polytetrafluoroethylene (PTFE) membrane was placed on the substrate in an area reserved for the debubbler/fluidic resistor and affixed in place using pressure-sensitive adhesive film. The fluidic resistor was then fabricated with a 0.5-mm polydimethylsiloxane (PDMS) layer having 20×100 μm serpentine channels formed using soft lithography. Inlet and outlet ports were formed using 0.5-mm biopsy punches. A second 0.5-mm layer of PDMS having openings for magnets was placed on and sealed to the first layer using corona treatment, and the PDMS layer was then affixed to the PMMA layer using corona treatment.

Another layer of PMMA having a 2×12 $mm^2$ opening was affixed on top of the PTFE membrane to form the debubbler. An O-ring (1 mm ID, 3 mm OD) was placed on the inlet of the channel. The same type of O-ring was placed on the outlet of the system and covered with a PMMA layer to affix it in place. Another PMMA layer was positioned to level the platform for microfluidic chips. The inlet O-ring was affixed using another PMMA layer. The PDMS channel was covered with a PMMA layer with openings for magnets to protect the channel from mechanical stress. Eight magnets (1 mm thickness, ⅛" diameter) were placed in their designated openings.

Figure 3:
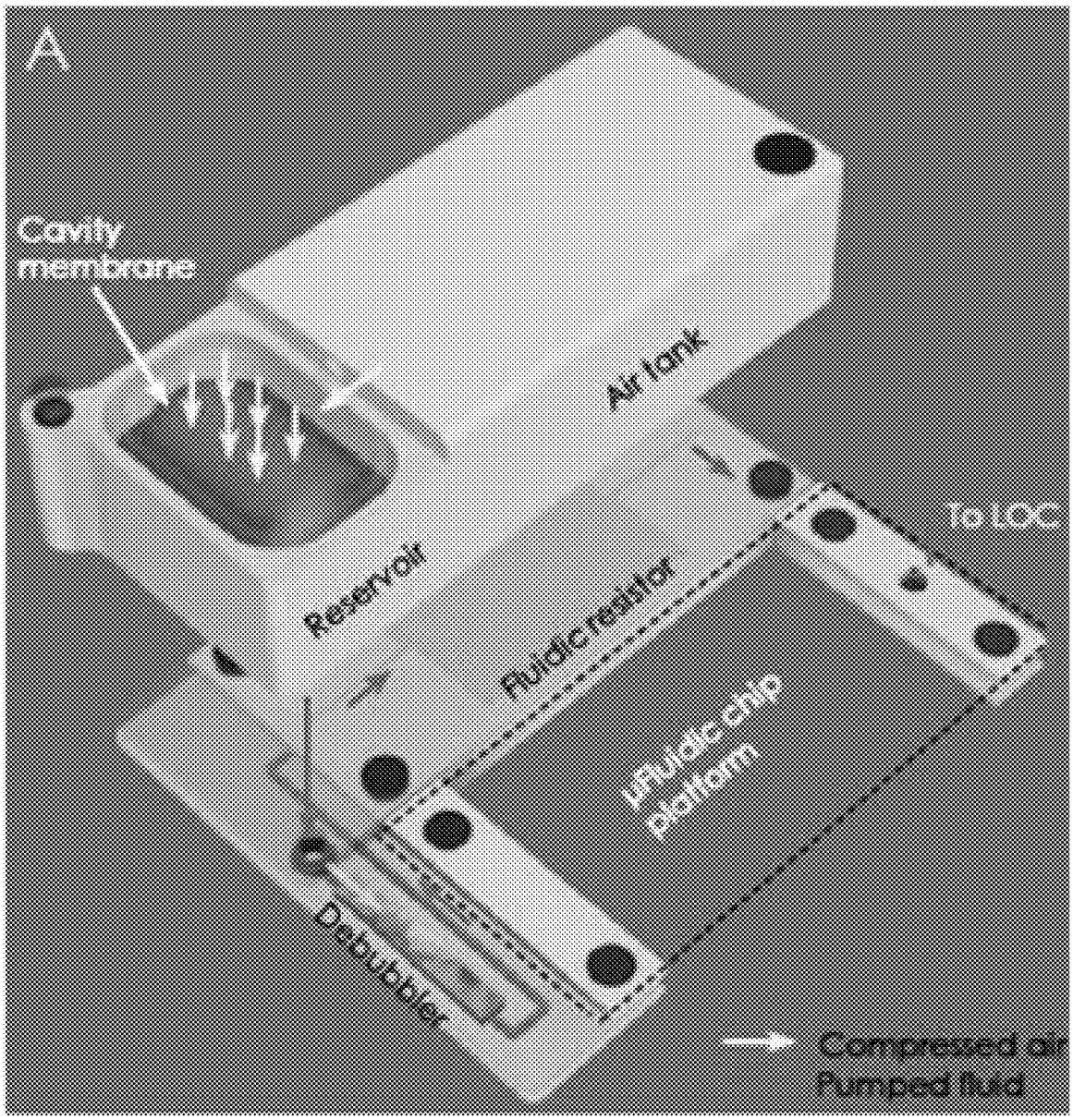
FIG. 3 is a perspective exploded view of a further embodiment of a miniature pressure-driven pump.

The air chamber and liquid chamber were placed on the fluidic resistor area with an air-tight sealed O-ring providing fluidic connection between the reservoir and the debubbler. The air chamber and liquid chamber were secured on top of the fluidic resistor area with the attraction forces of the magnets. FIG. 3 illustrates the device in exploded view.

When the experimental pump device is used, a working liquid is injected through the septum into the 1,000 μL reservoir. The air chamber is pressurized using a pressure regulator to a desired pressure and pneumatic pressure is then applied to the pump membrane to force the fluid from the reservoir. The integrated debubbler eliminates potential bubbles in the dispenses fluid, which is then propelled through the fluidic resistor, which controls the flow rate. The membrane also enables precise control over the flow rate through adjustment of the pneumatic pressure.

It is noted that different capacities and flow rates can be achieved due to the use of stereolithography and soft lithography for fabrication of device. Accordingly, the device can be easily scaled to suit various microfluidic applications. In addition, the above-described O-ring connector mechanism enables simple plug-and-play capability, which provides for simple and quick connection of the reservoir to the debubbler.

Figure 4:
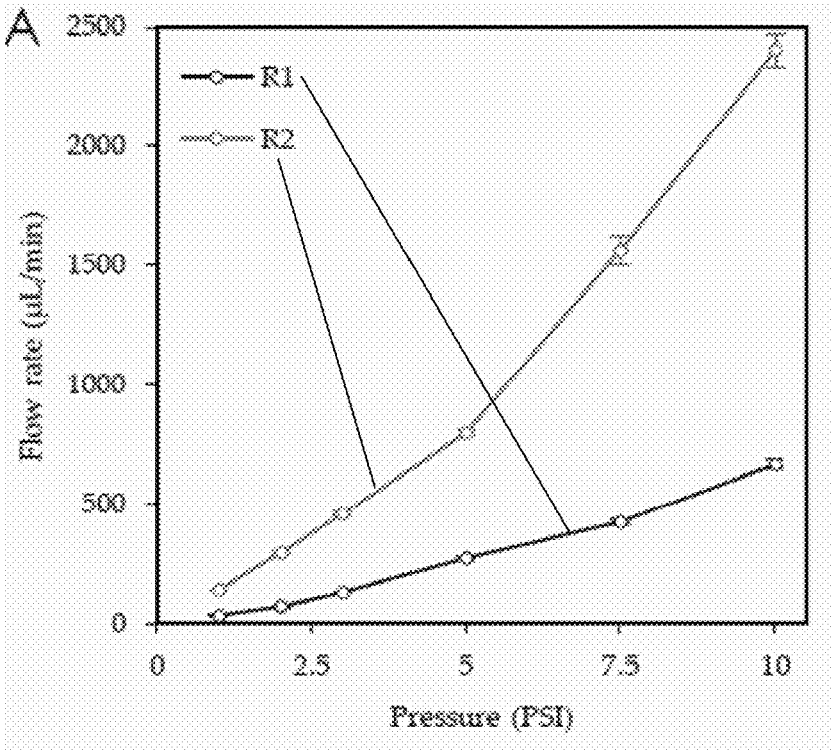
FIG. 4 is a graph that shows the effect of pressure on the flow rate of a miniature pressure-driven pump.

Experiments were performed on the fabricated pumps and their components. First, fluidic resistors having an area of 20×100 $\mu m^2$ area and different numbers of serpentines (n=10, 20, each round 3 cm long) were tested. The results are presented in FIG. 4 and show that, by tuning the pneumatic pressure within the range of 1 to 10 psi, the flow rate can be tuned from approximately 35 nL/min to −2400 nL/min (N=4, mean±SD).

Figure 5:
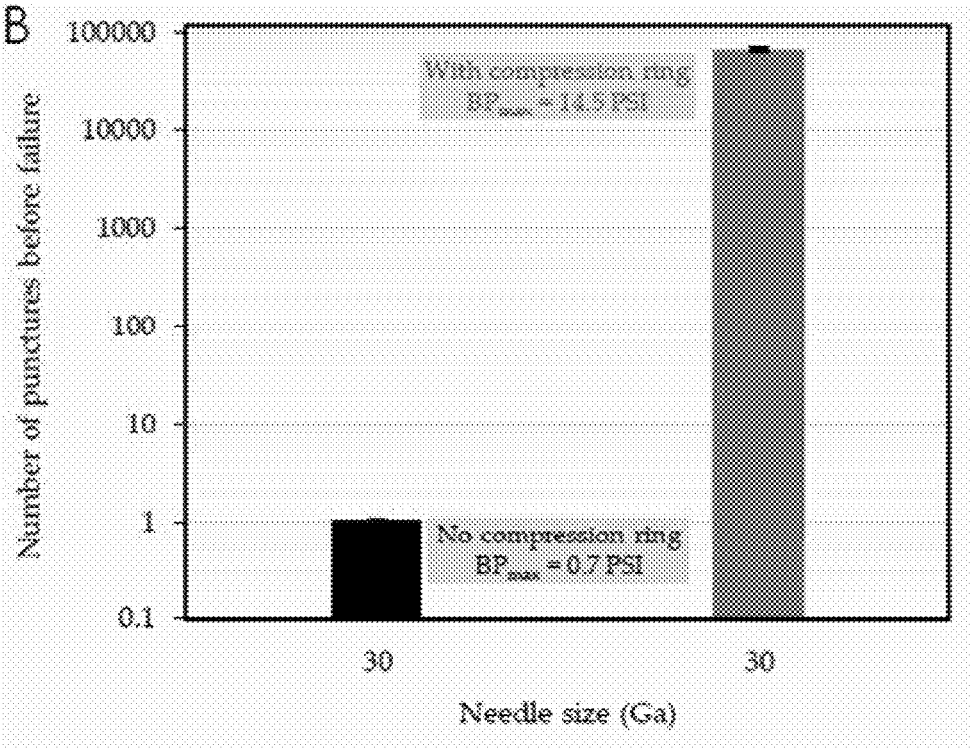
FIG. 5 is a graph that shows the effect of inclusion or exclusion of a pressure ring on a septum of a miniature pressure-driven pump.

Second, the septum samples were tested. The results are presented in FIG. 5 and show that the samples without a compression ring leaked at less than 0.7 PSI kPa backpressure with just one puncture with a 30 Ga needle. Adding a compression ring to the septum cap increased the number of punctures before failure to approximately 65,000 at 14.5 psi backpressure when puncturing with a 12° non-coring 30 Ga needle (N=4, mean±SD).

Figure 6:
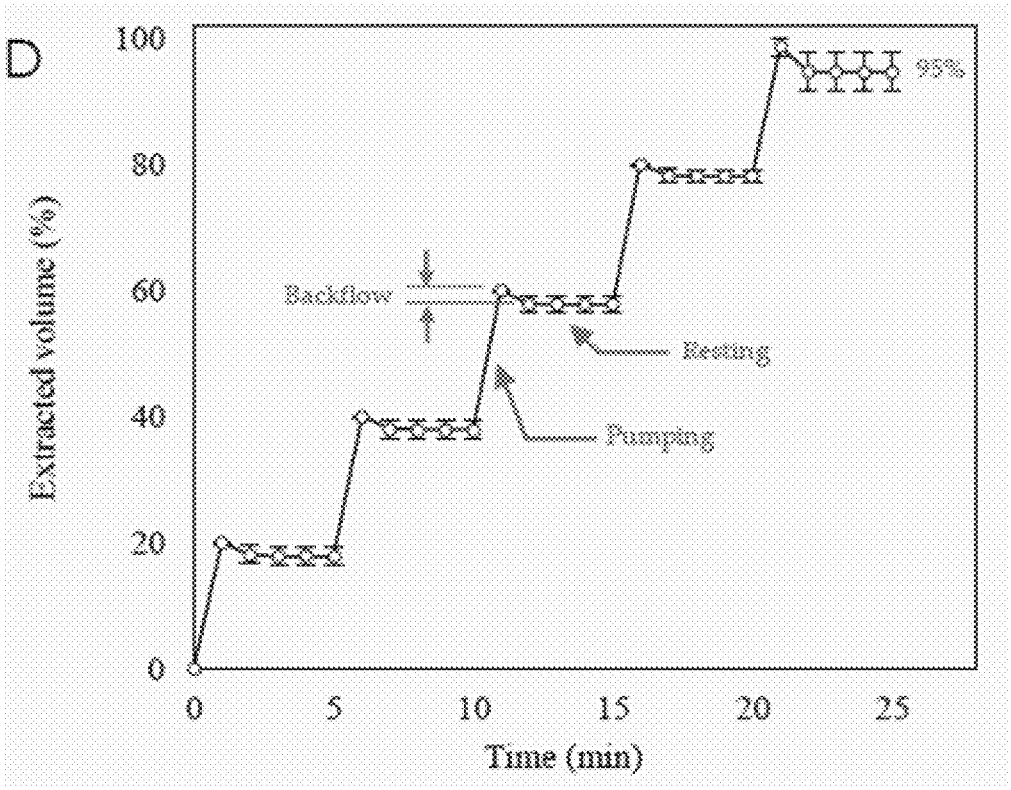
FIG. 6 is a graph that shows the amount of backflow that occurs for miniature pressure-driven pumps of various reservoir capacities.

Third, the pumps were tested for backflow. The results are presented in FIG. 6 and identify backflow due to restoring force for three different reservoir capacities of 1, 10, and 100 μL normalized by the total volume of each reservoir. The results show that the overall backflow is not significant (2% average) and occurs quickly (<2 min), suggesting stable behavior of the pump membrane long-term. The last step of the experiment showed that the average of the total extraction percentage among three reservoirs was 95% of the total volume (N=27, mean±SD).

Figure 7:
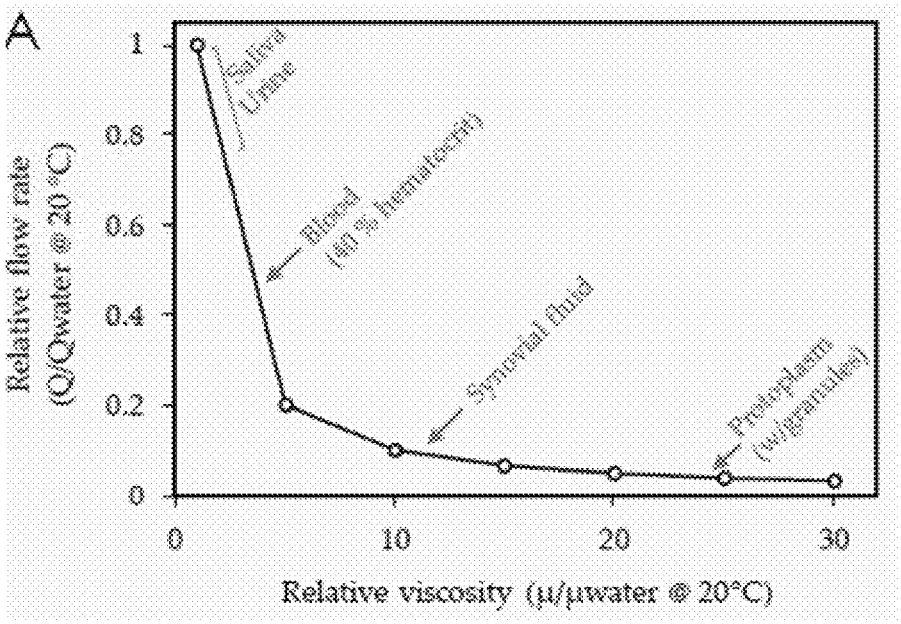
FIG. 7 is a graph that shows modeling results for the effect of fluid viscosity on flow rate for a miniature pressure-driven pump.
Figure 8:
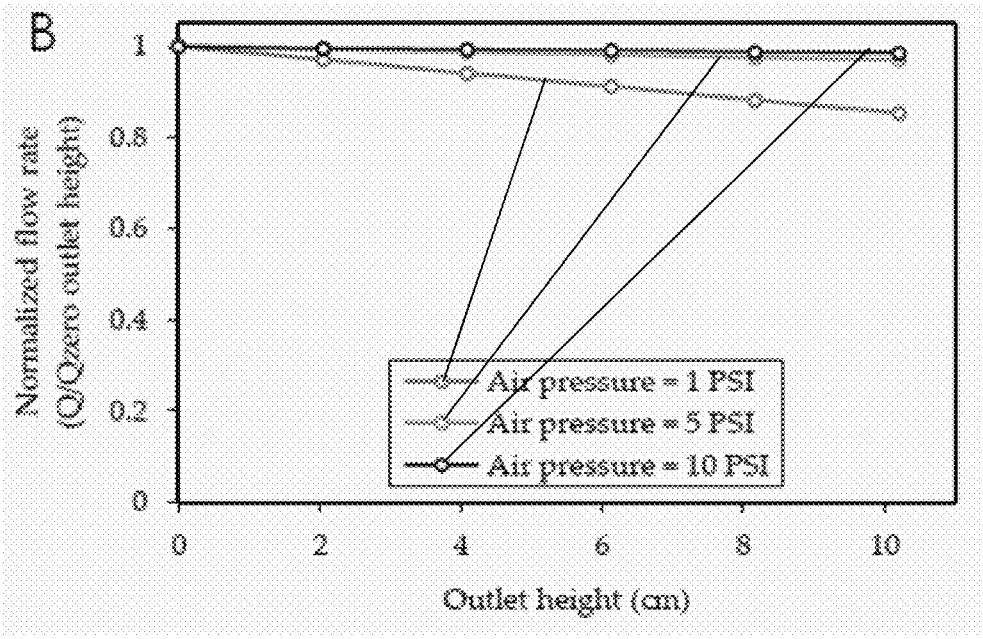
FIG. 8 is a graph that shows modeling results for the effect of downstream height on flow rate for a miniature pressure-driven pump.
Figure 9:
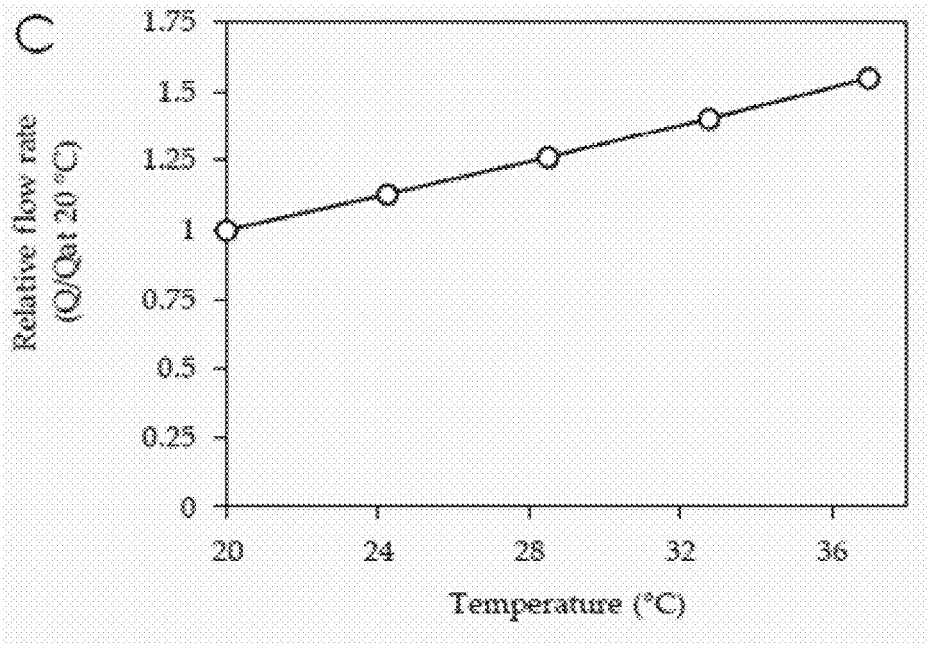
FIG. 9 is a graph that shows modeling results for the effect of ambient temperature on flow rate for a miniature pressure-driven pump.

The effects of different liquid viscosities were also studies using a COMSOL® model that was modified to cover a range of common fluids used in LOC applications. The results are presented in FIG. 7 and show that the flow rate is inversely related to the liquid viscosity. The COMSOL® model was also used to test flow rate as a function of downstream height within a common range of LOC applications. The results are presented in FIG. 8 and show that the flow rate can be almost independent of downstream height if higher driving pressures are used. Finally, the COMSOL® model was used to evaluate how the variation of the ambient temperature impacts liquid viscosity and pressurized gas pressure. The results are presented in FIG. 9 and show that changing from room temperature to an incubator temperature can impact the flow rate by approximately 50%.

While the disclosed pumps are well suited for LOC applications, it is noted that such pumps can be used in other applications. One such other application is drug delivery. For example, a pump in accordance with the above disclosure could be implanted under the skin or could be integrated into an external delivery device, such as a transdermal patch, to deliver drugs or other substances to a human or animal patient.

The invention claimed is:

1. A miniature pump comprising:

a first chamber;

a second chamber;

a deformable membrane provided within the second chamber that divides the second chamber into first and second sub-chambers, the second sub-chamber defining a reservoir configured to contain liquid to be dispensed;

a passage that connects the first chamber to the first sub-chamber; and an outlet in fluid communication with the reservoir;

wherein pressurized fluid within the first chamber flows through the passage and into the first sub-chamber to compress the deformable membrane and cause liquid contained within the reservoir to flow out from the reservoir through the outlet;

wherein the deformable membrane does not generate significant restoring forces when it is deformed and, therefore, will not return to its initial undeformed shape unless the reservoir is refilled; and wherein less than 2% of the volume of liquid discharged by the pump undergoes backflow into the reservoir.

2. The miniature pump of claim 1, wherein the deformable membrane is made of a biocompatible silicone material.

3. The miniature pump of claim 1, wherein the deformable membrane is made of a biocompatible parylene material.

4. The miniature pump of claim 3, wherein the parylene material is parylene C.

5. The miniature pump of claim 1, wherein less than 0.5% of the volume of liquid discharged by the pump undergoes backflow into the reservoir.

6. The miniature pump of claim 1, wherein the deformable membrane has a thickness no greater than 100 μm.

7. The miniature pump of claim 1, wherein the deformable membrane has a thickness of approximately 2 to 20 μm.

8. The miniature pump of claim 1, wherein the first chamber is an air chamber configured to hold pressurized air.

9. The miniature pump of claim 8, further comprising an air inlet in fluid communication with the air chamber through which the pressurized air can be supplied to the air chamber.

10. The miniature pump of claim 9, further comprising a valve associated with the air inlet through which the pressurized air can pass.

11. The miniature pump of claim 9, further comprising a liquid inlet in fluid communication with the reservoir through which the reservoir can be filled.

12. The miniature pump of claim 11, further comprising a septum associated with the liquid inlet through which liquid can pass.

13. The miniature pump of claim 12, further comprising a compression ring that compresses the septum to induce lateral stress within the septum that prevents leakage.

14. The miniature pump of claim 11, further comprising a debubbler in fluid communication with the outlet, the debubbler being configured to remove bubbles from dispensed liquid.

15. The miniature pump of claim 14, further comprising a fluidic resistor in fluid communication with the debubbler, the fluidic resistor being configured to control a rate of flow of the dispensed liquid.

16. A miniature pressure-driven pump comprising:

a pump body comprising an internal air chamber, an internal pump chamber, and an internal passage connecting the air chamber to the pump chamber, the pump body further comprising an air inlet in fluid communication with the air chamber, a liquid inlet in fluid communication with the pump chamber, and a liquid outlet in fluid communication with the pump chamber, wherein all surfaces of the pump body are coated with a layer of parylene C;

a deformable membrane provided within the pump chamber that divides the pump chamber into an air sub-chamber and a liquid sub-chamber, the liquid sub-chamber defining a liquid reservoir configured to contain liquid to be dispensed, wherein the deformable membrane is made of parylene C, has a Young's modulus of 2 to 3 GPa, and is 2 to 20 μm thick;

a valve provided within the air inlet through which air can pass to fill the air chamber with pressurized air;

a septum provided within the fluid inlet through which fluid can pass to fill the liquid reservoir with liquid;

a compression ring that compresses the septum to induce lateral stress within the septum that prevents liquid leakage;

a debubbler in fluid communication with the liquid outlet, the debubbler being configured to remove bubbles from dispensed liquid; and a fluidic resistor in fluid communication with the debubbler, the fluidic resistor being configured to control a rate of flow of the dispensed liquid;

wherein pressurized air injected into the air chamber via the air inlet flows through the internal passage and into the air sub-chamber to compress the deformable membrane and cause fluid contained within the fluid reservoir to flow out from the reservoir through the liquid outlet;

wherein the deformable membrane does not generate significant restoring forces when it is deformed and, therefore, less than 2% of the volume of liquid discharged by the pump undergoes backflow into the reservoir.

* * * * *